US007207177B2

(12) United States Patent
Neumann et al.

(10) Patent No.: US 7,207,177 B2
(45) Date of Patent: Apr. 24, 2007

(54) POSITION CONTROL DEVICE FOR AN ELECTRICAL-FLUID POWER DRIVE AND A METHOD OF POSITIONING

(75) Inventors: Rüdiger Neumann, Ostfildern (DE); Armin Hartmann, Ostfildern (DE)

(73) Assignee: Festo AG & Co., Esslingen (DE)

( * ) Notice: Subject to any disclaimer, the term of this patent is extended or adjusted under 35 U.S.C. 154(b) by 363 days.

(21) Appl. No.: 10/901,000

(22) Filed: Jul. 28, 2004

(65) Prior Publication Data

US 2006/0021348 A1 Feb. 2, 2006

(51) Int. Cl.
*F01B 21/04* (2006.01)

(52) U.S. Cl. ..... 60/706; 60/711; 60/716; 60/719; 91/358 R; 91/361

(58) Field of Classification Search ..... 60/700, 60/701, 702, 705, 706, 711, 716, 719; 91/358 R, 91/361

See application file for complete search history.

(56) References Cited

U.S. PATENT DOCUMENTS

| | | | | |
|---|---|---|---|---|
| 4,124,980 | A * | 11/1978 | Olson et al. | 60/700 |
| 4,628,499 | A | 12/1986 | Hammett | |
| 4,805,740 | A * | 2/1989 | Wilke et al. | 188/173 |
| 5,590,580 | A | 1/1997 | Nagai | |
| 5,656,903 | A | 8/1997 | Shui et al. | |
| 5,803,211 | A * | 9/1998 | Wilke | 188/173 |
| 6,138,458 | A | 10/2000 | Griffin | |
| 6,279,374 | B1 * | 8/2001 | Irokawa et al. | 73/1.79 |
| 2004/0056536 | A1 | 3/2004 | Finkbeiner et al. | |
| 2004/0099784 | A1 | 5/2004 | Kienholz | |

FOREIGN PATENT DOCUMENTS

| | | |
|---|---|---|
| DE | 19503145 A1 | 8/1995 |
| GB | 2 315 371 A | 1/1998 |
| JP | 60146955 | 8/1985 |
| JP | 7217607 | 8/1995 |

* cited by examiner

*Primary Examiner*—Hoang Nguyen
(74) *Attorney, Agent, or Firm*—Hoffman & Baron, LLP

(57) ABSTRACT

A method and a position control device for an electrical-fluid power drive comprising a fluid power and an electrical actuator for driving a force output point. The invention contemplates the following steps: of derivation of a target overall drive force, to be provided by the fluid power actuator and the electrical actuator jointly, for a positioning movement of the force output point to a positioning location able to be predetermined for the position control device, derivation of a target fluid drive force, to be provided by the fluid power actuator, and derivation of a target electrical drive force to be provided by the electrical actuator, on the basis of the target overall drive force in such a manner that the target electrical drive force is provided for the fractions of the target overall drive force which are more dynamic than the target fluid power drive force and for operation of the fluid power actuator in accordance with the target drive force and of the electrical actuator in accordance with the target electrical drive. The splitting of the force is preferably implemented by a high pass and a low pass.

24 Claims, 2 Drawing Sheets

POSITION CONTROL DEVICE FOR AN ELECTRICAL-FLUID POWER DRIVE AND A METHOD OF POSITIONING

FIELD OF THE INVENTION

The invention relates to a position control device for an electrical-fluid power drive comprising a force output point, and a fluid power actuator together with an electrical actuator for driving the force output point. The invention furthermore relates to an electrical-fluid power drive with such a position control device and also to a respective method for the positional control of the drive.

BACKGROUND OF THE INVENTION

Such a position control device is for example disclosed in the German patent publication DE 195 03 145 C2. The fluid power actuator is for example a pneumatic cylinder, the electrical actuator is for example an electrical linear drive, including a lead screw drive or the like. The prior art position control device controls the pneumatic actuator in such a manner that it halts in the vicinity of a target position, i.e. a positioning location. Then the position control device controls the electrical actuator for precision positioning of the force output point. The pneumatic and the electrical actuators are as it were operated in series with one another. The pneumatic actuator serves furthermore as a weight compensation means, which prevent over-loading of the electrical actuator in continuous operation. The two actuators of the known drive furthermore have to perform a respective individual function: the pneumatic actuator serves for coarse positioning and statically holding the force output point, while the electrical actuator serves for fine or precision positioning of the force output point. The electrical actuator compensates for the disadvantages of the pneumatic actuator, for example the less satisfactory accuracy of positioning.

Further disadvantages of a pneumatic drive are for example its elaborate regulation and slow build up of force. On the contrary a pneumatic actuator can provide substantial amounts of force at the expense of only a small heating effect. Although an electrical actuator is quick and precise, on the other hand continuous operation of an electrical actuator leads to substantial heating, this entailing a complex cooling means.

SUMMARY OF THE INVENTION

Accordingly one object of the present invention is to provide a method and a device, which in the case of a fluid power drive of the type initially mentioned the advantages of the fluid power and of the electrical actuator are combined in an optimum fashion.

In order to achieve these and/or other objects appearing from the present specification, claims and drawings, in the present invention the position control device of the type initially mentioned is designed to derive the setpoint or target overall drive force values of a target overall drive force, to be provided by the fluid power actuator and the electrical actuator jointly, for a positioning movement of the force output point to a positioning location able to be predetermined for the position control device, to derive setpoint or target fluid drive force values of a setpoint or target fluid power drive force, to be provided by the fluid power actuator, and to derive setpoint or target electrical drive force values of a setpoint or target electrical drive force to be provided by the electrical actuator, the target fluid drive force values being derived on the basis of the target overall drive force values, and the target electrical drive force values being derived in such a manner that the target electrical drive force is provided for the fractions of the target overall drive force, which are more dynamic than the target fluid power drive force. The electrical-fluid power drive in accordance with the invention possesses has such a position control means. Furthermore in order to achieve the object of the invention methods are provided in accordance with further independent claims.

In contradistinction to prior art hybrid drive the dynamic advantages of the electrical actuator are employed in a optimum manner. The dynamic fractions of the target overall drive force are more especially necessary during acceleration or retarding of the force output point. In such phases at the fluid power actuator, for example in the case of a pneumatic actuator, only comparatively a small drive force is available. The electrical actuator accordingly compensates for the dynamic disadvantages of the fluid power actuator. However if there has already been a build up of force at the fluid power actuator, the electrical actuator is operated to reduce its output. The principal drive load is then to be supplied by the fluid power actuator. The electrical actuator is then loaded less and may for example cool down. The fluid power actuator will conveniently serve to provide a continuous force or power and in the case of vertical operation also to provide gravity compensation. The electrical actuator deals with rapid force surges and is preferably designed to be well regulated and to be precise. The pneumatic and the electrical actuators are advantageously driven in parallel in accordance with the invention.

The electrical-fluid power drive in accordance with the invention, which is preferably an electrical-pneumatic drive, is highly dynamic, provides a high power density, renders possible precise positioning and does not require any or only little cooling. It is clear that an electrical-fluid power drive in accordance with the invention may comprise a plurality of fluid power actuators and a plurality of electrical actuators and the position control device in accordance with the invention is designed for the control and/or regulation of such an electrical-fluid power drive.

During an initial part of an acceleration phase the electrical actuator preferably provides a larger drive force fraction than the fluid power actuator. Following such initial phase the state is preferably reversed, i.e. the fluid power actuator provides a larger drive force fraction than the electrical actuator.

In principle the two actuators may be designed in any suitable fashion. The electrical actuator may provide larger drive forces than the fluid power actuator and vice versa. In the case of a particularly advantageous design the pneumatic actuator provides a rated force or a continuous force, which is approximately equal to the maximum or peak force of the electrical actuator. As a rule the electrical actuator will have a peak force, which is equal to four times its rated or continuous force. Such an electrical-fluid power drive in accordance with the invention provides approximately a continuous force equal to four times the force of a comparable purely electrical drive.

It has turned out to be advantageous if the fluid power actuator provides larger time-averaged drive force fractions than the electrical actuator. During the acceleration phase of the positioning movement of the force output point the fluid power actuator preferably produces an overall larger drive fraction than the electrical actuator. This will apply also for a holding phase, following an acceleration phase, in the case of which the force output point is held at the positioning location.

Preferably, the position control device derives the target fluid drive force values and the target electrical drive force values in a fashion dependent on the change frequency of the target overall drive force values. The target fluid drive force values are best essentially formed on the basis of fractions of the target overall drive force values with a lower change rate or frequency and the target overall electrical drive force values are formed in a corresponding manner essentially on the basis of fractions of the target overall drive force values with a high change rate or high change frequency. For instance for deriving the target electrical drive force values a high pass is employed and for deriving the target fluid drive force values a low pass is employed. Furthermore a sort of frequency responsive switch or a dividing/crossover network, as employed for example in loudspeaker systems, or other digital and/or analog filters, may be employed.

The target fluid drive force values preferably constitute the input values for pressure regulation means or pressure control means for the fluid power actuator. The target electrical drive force values will conveniently constitute input values for current regulating means or current control means for the electrical actuator. The pressure regulating means or pressure control means act for example on a servo valve or proportional valve, on high speed switching valves or the like, by the intermediary of which the pressure medium supply and discharge to and from the fluid power actuator is able to be adjusted. The pressure regulating means or, respectively, the pressure control means comprise for example a force amplifier for the operation of the fluid power actuator. The current regulating means or the current control means are preferably adapted to perform error compensation in respect of control deviations due to the pressure regulating means or, respectively, the pressure control means using the pressure regulating means. It is accordingly possible to use a comparatively low quality pressure regulator. Any resulting lack of positioning and/or of force accuracy will be compensated for by the current regulating means.

The target overall drive force values are preferably provided for by position regulating means. The position regulating are for example designed in the form of P-PI cascade regulators, as state regulators with a function for monitoring interfering effects and/or means for amplification of control quantities. The current regulating means and/or pressure regulating means and/or the position regulating means preferably constitute a component of the position control system. An advantageous design of the position control means will then be such that the position regulating means form the target overall drive force values. Force splitting means, for example in the form of the above mentioned filters, split the target overall drive force values into target electrical drive force values and target fluid drive force values, which the current regulating means or, respectively, the pressure regulating means receive as inputs.

It will be clear that the hybrid drive in accordance with the invention will preferably also implement known functions, as for example such that the electrical actuator is controlled for precision positioning of the force output point and the fluid power actuator provides static holding forces, for example during vertical operation. Static drive force fractions are, as it were, automatically assigned, for example by the above mentioned low pass, to the fluid power actuator.

The position control device is preferably able to be universally employed. In the case of the electrical actuator being absent or inactive the position control device will exclusively control the fluid power actuator. This advantageous property of the position control device will make itself felt f. i. during failure of one or more actuators. On the other hand it may be employed with advantage also in the case of a modular design, which is preferred for the electrical-fluid power drive. In this case the fluid power actuator and the electrical actuator will respectively constitute one module, able to be operated separately or in combination with one another one. In the case of separate operation a position control device in accordance with the invention may be individually assigned to each of the actuators. It is however also possible for the actuators to combined together modularly, in which case for example one or two electrical actuators will be combined with a fluid power actuator or vice versa and the position control function will be overall assumed by one position control device in accordance with the invention.

A module combination of pressure sensors, position detecting means, as for example a displacement sensor system, switching valves or the like is also possible with the modular electrical-fluid power drive in accordance with the invention. The electrical actuator and the fluid power actuator will furthermore, in the case of a modular design, preferably constitute an integrated drive unit.

The electrical actuator and the fluid power actuator are best in the form of coupled drive units, linear drives and rotary drives being possible. Moreover a combination of a linear drive and a rotary drive is possible, in which case for example the electrical actuator is constituted by a lead screw drive and the fluid power actuator is constituted for example by a linear pneumatic cylinder.

Further advantageous developments and convenient forms of the invention will be understood from the following detailed descriptive disclosure of one embodiment thereof in conjunction with the accompanying drawings.

DETAILED DESCRIPTION OF THE PREFERRED EMBODIMENTS

Figure 1:
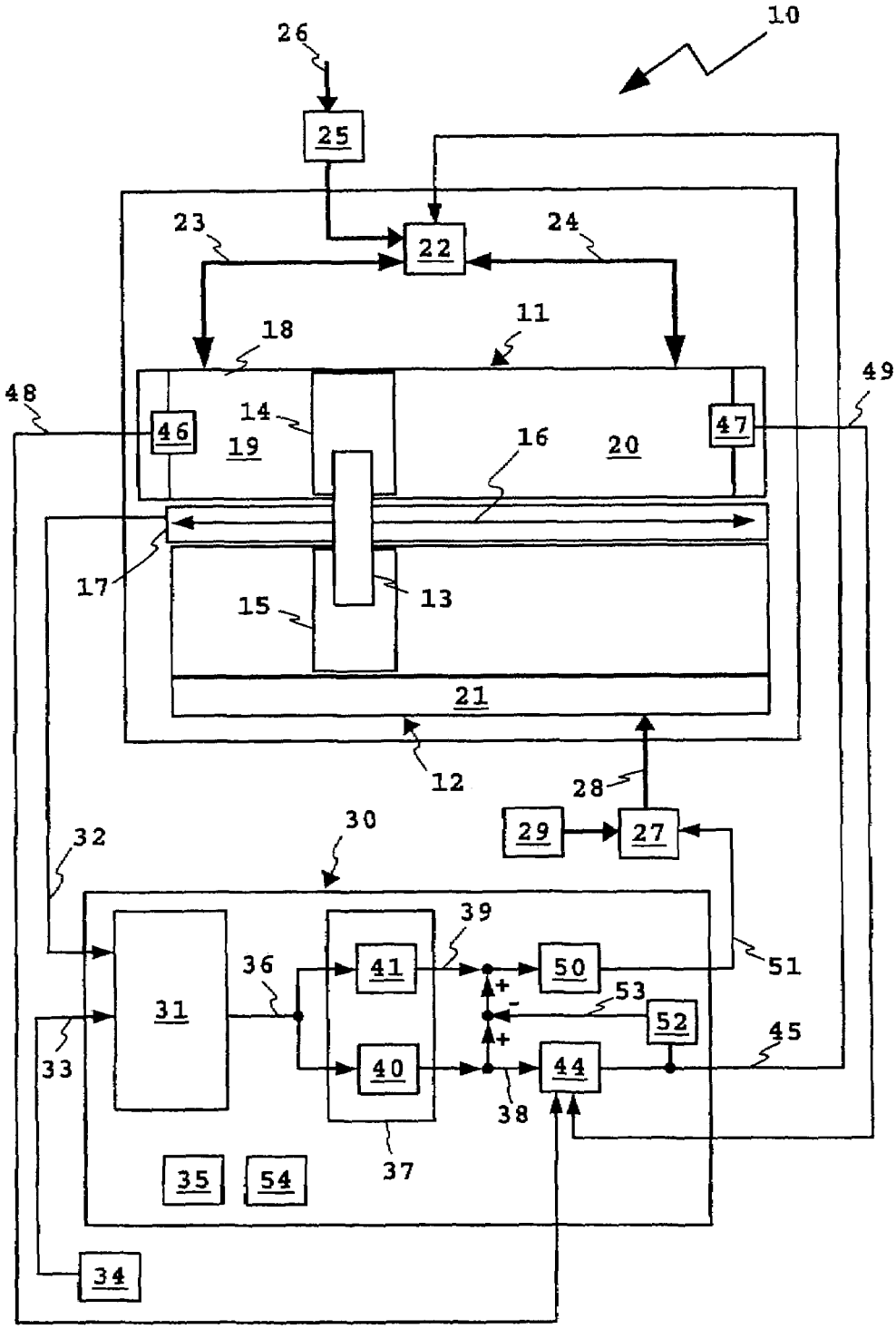
FIG. 1 shows an electrical-fluid power drive in accordance with the invention with a position control device also in accordance with the invention.

An electrical-fluid power drive 10 is illustrated in FIG. 1 in a highly diagrammatic manner having a fluid power, in the present case pneumatic, actuator 11 and an electrical actuator 12. The actuators 11 and 12 jointly drive a drive element 13 serving as a force output point. The drive element 13 is kinematically coupled with a piston 14 of the pneumatic actuator 11 and an armature 15 of the electrical actuator 12. In the example the drive element 13 is permanently connected with the piston 14 and the armature 15. The drive element 13 is for example seated at the top on the piston 14 and the armature 15. In principle it would however be possible to have a drive element projecting in the longitudinal direction of extent and generally in the direction of a positioning displacement 16 past the actuators.

The actuators 11 and 12 are in the present case linear drives. The electrical actuator 12 is designed in the form of a linear motor. However, a design in the form of a rotary lead screw, as a toothed belt drive or the like etc. would also be possible.

The piston 14 and the armature 15 are accordingly the drive element 13 are able to be longitudinally shifted along the positioning displacement 16. The position of the drive element 13 or, respectively, of the piston 14 and of the armature 15 is detected by a position detecting system 17, which for example operates on a magnetic basis.

The piston 14 is arranged in a longitudinally movable fashion in a piston receiving space 18 in the pneumatic actuator 11. The piston 14 divides the piston receiving space 18 into space parts 19 and 20. By means of a pressure medium, for example compressed air, flowing into and out of the space parts 19 and 20 the piston is reciprocated along the positioning displacement or path 16.

A valve arrangement 22 causes the compressed air to flow into the space parts 19 and 20 and lets it off again. The compressed air 26 necessary for this purpose is supplied by way of a servicing device 25 into the valve arrangement 22. The servicing device 25 filters and/or mist-oils the compressed air 26. The valve arrangement 22 comprises for example one or more servo valves, high speed switching valve or the like for the dynamic and more particularly highly dynamic pressurization and venting of the space parts 19 and 20.

The armature 15 is shifted electrodynamically along the positioning path 16 to and fro. The armature 15 comprises for example a permanent magnet or is constituted by a permanent magnet. Dependent on the flow of current through a coil arrangement, not illustrated, of a stator 21 a traveling magnetic field is produced, by which the armature 15 is reciprocated along the positioning displacement.

For the supply of current 28 to the stator 21 a current source means 27, for example in the form of an electrical force amplifier arrangement is provided, which is supplied with electrical force by a force supply 29.

The pneumatic actuator 11 does admittedly build up its force slowly and in comparison with the electrical actuator 12 its accuracy of positioning is less. However it provides large driving forces, is economic, does not heat up even in the case of substantial driving forces, or only does so to a slight extent, and reaches substantial terminal speeds. In contradistinction to this the electrical actuator 12 builds up its force rapidly, may be regulated with precision and is suitable for accurate positioning of the drive element 13 along the positioning displacement 16. However, the electrical actuator 12 becomes heated during continuous operation or, respectively, exerting large drive forces, has a lower power density than the pneumatic actuator 11 and is, for example owing to the magnetic armature 15, comparatively expensive. A position control device 30 in accordance with the invention combines the advantages of the actuators 11 and 12 in an optimum manner and compensates for the respective disadvantages of the actuators 11 and 12. The position control device 30 may for example be a separate module or may be integrated in the cylinder end plate of the pneumatic actuator 12.

The position control device 30 renders possible a positioning of the drive element 13 to reach a predetermined position location along the positioning displacement 16. In principle it would also be possible for the position control device to so control the actuators 11 and 12 that in each case the complete positioning displacement 16 is moved along. That is to say, the predetermined positioning locations are constituted by terminal abutments on the piston or, respectively, on the armature 15 at the ends of the positioning displacement 16.

The position regulating means 31 of the position control device 30 receive actual position values 32 from the position system 17, such values representing the respective position of the drive element 13 along the positioning displacement 16. A higher-level control 34 supplies the positioning means 31 with target position values 33. The target position values 33 may also be held in a memory 35 of the position control device 30. On the basis of the actual position values 32 and the target position values 33 the position regulating means 31 derive target overall drive force values 36 serving for positioning the drive element 13 on a position location, predetermined by a target position value along the positioning displacement 16. The position regulating means 31 comprise for example a PID regulator, a P-PI cascade regulator, a state regulator with a function for monitoring interfering effects and/or means for amplification of control quantities or the like.

On the basis of the target overall drive force values 36 force splitting means 37 derive target fluid drive force values 38, which correspond to a drive force to be provided by the fluid power actuator 11, and furthermore target electrical drive force values 39, which correspond to a target electrical drive force to be provided by the electrical actuator 12. All in all the drive force values 38 and 39 result in the target overall drive force values 36. The force splitting means 37 accordingly split the drive force, which is to be provided overall by the electropneumatic drive 10, into a pneumatic component 38 and an electrical component 39, the electrical component meeting the dynamic drive force fractions and the pneumatic-fluid power component meeting the comparatively smaller dynamic fractions of the overall drive force.

The force splitting means 37 operate like a frequency responsive switch. The force splitting means 37 comprise a low pass 40, which allows the passage of the less dynamic fractions of the target overall drive force values 36. A high pass 41 allows the passage of the more dynamic fractions of the target overall drive force values 36. In their conducting and, respectively, non-conducting action the high pass 41 and the low pass 40 are dependent on the rate of change or frequency of change of the target overall drive force values 36.

Figure 2:
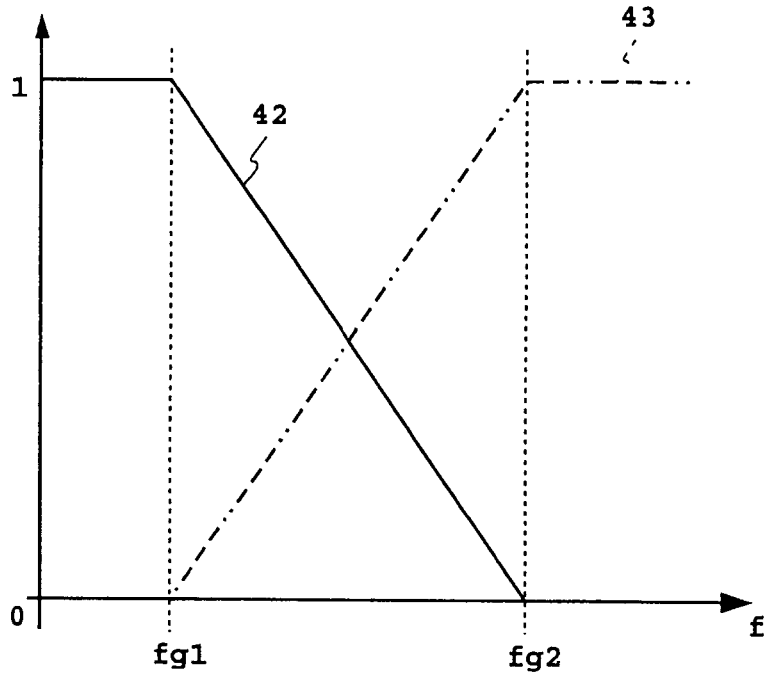
FIG. 2 shows changes in frequency of force splitting means of the position control device in accordance with FIG. 1.

FIG. 2 shows a diagrammatic example of a frequency characteristic 42 of the low pass 40 and a frequency characteristic 43 of the high pass 41. As far as a certain limit frequency fg1 merely the low pass 40 is conductive for the target overall drive force values 36. As from the limit frequency fg1 as far as a limit frequency fg2 the conductivity of the low pass 40 decreases, for example linearly and reaches the value "0". The high pass 41 on the other hand becomes increasingly conductive, for example linearly, and at the limit frequency fg2 becomes completely conductive. The sum of the frequency characteristics 42 and 43 is constant at each frequency f and is for example "1".

The target fluid drive force values 38 constitute input values of pressure regulating means 44.

The pressure regulating means 44 regulate the pressurizing action and venting action of the pneumatic actuator 11. For this purpose the pressure regulating means 44 send a pressure control signal 45 to the valve arrangement 22. From pressure sensors 46 and 47, which are assigned to the space parts 19 and 20, the pressure regulating means receive actual pressure values 48 and 49. The actual pressure values 48 and 49 respectively represent the pressure obtaining in the space parts 19 and 20. On the basis of the target fluid drive force values 38 and furthermore of the actual pressure values 48 and 49 the pressure regulating means 44 regulate the actuator 11. It will be clear that instead of the pressure sensors 46 and 47, or in a manner complementary thereto, a differential pressure sensor may be provided. Moreover, converting means may be joined with the input of the pressure regulating means 44, such converting means converting the target fluid drive force values 38 into target pressure values and/or target differential pressure values and holding them for the pressure regulating means 44.

Current regulating means 50 regulate the electrical actuator 12 on the basis of the target electrical drive force values 39. The current regulating means 50 generate a current control signal 51 for control of the current source means 27. It is possible for the current regulating means 50 to be supplied with actual current values, which represent the current supply state of the stator 21. However, for the sake of simplification of the figure, this is not illustrated. Converting means, which are not illustrated, may be connected with the input of the current regulating means 50 which convert the target electrical drive force values 39 into target current values.

The current regulating means 50 may react to target value changes of for example one kilohertz and the pressure regulating means 44 to target value changes of up to approximately 50 hertz. The splitting, necessary therefor, of the target overall drive force values 36 is implemented by the force splitting or dividing means 37.

The current regulating means 50 compensate for regulation errors of the pressure regulating means 44. Converting means 52 produce the average the fluid power drive control values 53 from the pressure control signal 45. Then the difference is found between the fluid drive force control values 53 and the target fluid drive force values 38, and is added to the target electrical drive force values 39. Accordingly the current regulating means 50 compensate for regulation inaccuracies, which are contained in the pressure control signal.

The current source means 27 may be realized as software and hardware. It for example comprises a program code, which is able to be executed by a processor 54 and is stored in the memory 35.

Figure 3:
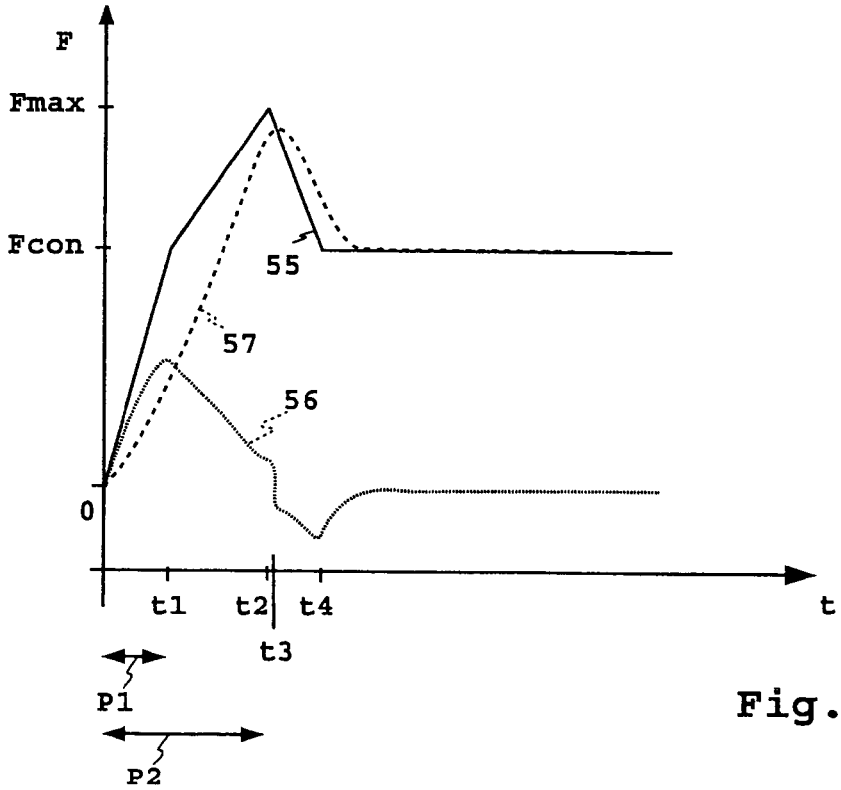
FIG. 3 represents examples of changes of a target overall drive force and a target electrical drive force in the case of a target electrical drive force in the case of the drive in accordance with FIG. 1.

The manner of operation of the position control device 30 will be more particularly apparent from FIG. 3: the position regulating means 31 find a target overall drive force value characteristic 55 for one positioning stroke of the drive element 13 along the positioning displacement 16. In principle it would be possible as well for the position control device 30 to be preset with the target overall drive force value characteristic 55, for example by way of the higher-level control 34. Up to a point t1 in time the drive element 13 is to be sharply accelerated at a high rate. From the point t1 in time to a point t2 in time the target overall drive force decreases to a value Fmax and goes down to a value Fcon at a point t4 in time. As from the point t4 in time the target overall drive force Fcon is kept constant. For instance, the drive element 13 is held constant at a predetermined location.

Up to the point t1 in time the drive element 13 is sharply accelerated during an acceleration phase P2. During an initial phase P1 as far as the point in time t1 the drive force necessary for the acceleration is supplied essentially by the electrical actuator 12, something which is made clear by a sharp increase in the target electrical drive force value characteristic 56 as far as the point in time t1. As regards the supply of drive force the pneumatic actuator 11 lags behind the electronic actuator 12.

At a point in time t1 however the pneumatically produced fraction of the build up of force will have already have progressed so far that the target electrical drive force value characteristic 56 is already decreasing again, while on the other hand the target fluid drive force value characteristic 57 will increase sharply up till a point t3 in time. All in all the pneumatic actuator 11 in the present configuration will in the acceleration phase P2 supply a larger fraction of the overall drive force than the electrical actuator 12. It is in principle also possible for the two actuators 11 and 12 to supply equal fractions. It is also possible for the electrical actuator 12 to supply larger fractions, particularly in the acceleration phases, of the drive force than the pneumatic actuator and for the pneumatic actuator 11 to supply larger fractions of the drive force in the holding phase. The respective design of the drive 10 is dependent on the operational situation, acceleration phases and holding phases of the drive 10 having to be taken into account in the design of the actuators 11 and 12.

In the case of retarding of the drive element 13 between the points t2 and t4 in time the electrical actuator 12 as it were more rapid than the pneumatic actuator 12. It is merely as from points t2 and t4 in time that the electrical actuator 12 is as it were more rapid than the pneumatic actuator 11. It is only as from a point t3 in time, which directly follows the point t2 in time, that the target fluid drive force decreases, while on the other hand the target electrical drive force will pass through zero and will become negative so that the electrical actuator 12 and accordingly the drive 10 is very sharply braked.

As from the point t4 in time the drive element 13 will for example be held at the same location. In this case the pneumatic actuator 11 will provide the necessary holding force, as for example the drive force Fcon. The electrical actuator 12 can as from this point t4 in time for example cool off. The holding force Fcon is necessary for example in the case of an oblique or vertical installed position of the drive 10.

In the case of a preferred horizontal installation of the drive 10 the drive element 13 is, for example in the case of a constant drive force Fcon, moved as from the point t4 in time at a constant speed toward a desired position location. Prior to reaching the position location (not shown in FIG. 3) the position control device 30 causes the actuators 11 and 12 to perform a retarding operation. In a manner similar to the acceleration operation between the points t1 and t3 in time the electrical actuator then makes available the major part of the retarding force (i.e. negative driving force), which is continuously reduced in step with the retarding force built up in the case of the fluid power actuator 11. Until the positioning location is reached it is necessary for the overall drive force or, respectively, overall retarding force, to be reduced down to "0" again. In the case of the fluid power actuator 11 a modification of the retarding force takes place more slowly than is the case with the electrical actuator 12. Accordingly the position control device 30 drives the actuators 11 and 12, directly prior to reaching the position location, for example in such a manner that the electrical actuator 12 provides a positive drive force for compensation of a negative drive force of the fluid power actuator 1 and the positive drive force of the electrical actuator 12 are continuously reduced to "0". At the position location the sum of the negative drive force of the fluid power actuator 11 and the positive drive of the electrical actuator 12 are "0".

Modifications in the invention are readily possible:

It is possible for the position control device 30 for example 30 only comprises the force splitting means 37, and possibly in addition the position regulating means 31 and/or the current regulating means 50 regulating means 44.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

The invention claimed is:

1. A position control device for an electrical-fluid power drive comprising a force output point, and a fluid power actuator together with an electrical actuator for driving the force output point wherein said device is designed to derive the target overall drive force values of a target overall drive force, to be provided by the fluid power actuator and the electrical actuator jointly, for a positioning movement of the force output point to a positioning location able to be predetermined for the position control device, to derive target fluid drive force values of a target fluid power drive force, to be provided by the fluid power actuator, and to derive target electrical drive force values of a target electrical drive force to be provided by the electrical actuator, the target fluid drive force values and the target electrical drive force values being derived on the basis of the target overall drive force values in such a manner that the target electrical drive force is provided during those portions of the target overall drive force comprising a higher rate of change or frequency of change than those portions of the target overall drive force during which the target fluid power drive force is provided, wherein the position control device is designed for the derivation of the target fluid drive force values and of the target electrical drive force values in a fashion dependent on the change rate or change frequency of the target overall drive force values.

2. The position control device as set forth in claim 1, wherein the position control device is so designed for deriving the fluid drive force values and the electrical drive force values that the electrical actuator during an initial phase of an acceleration phase of the force output point produces a larger drive force than the fluid power actuator.

3. The position control device as set forth in claim 1, wherein the position control device is so designed for deriving the target fluid drive force values and the target electrical drive force values that during an acceleration phase of the force output point the fluid power actuator produces a generally larger drive force fraction than the electrical actuator.

4. The position control device as set forth in claim 1, wherein the position control device is designed for the derivation of the target fluid drive force values and of the target electrical drive force values in a fashion dependent on the change rate or change frequency of the target overall drive force values.

5. The position control device as set forth in claim 1, wherein the position control device derives the target fluid drive force values essentially on the basis of fractions of the target overall drive force values with a lesser change rate or change frequency and derives the target electrical drive force values essentially on the basis of fractions of the target overall drive force values at a high change rate or change frequency.

6. The position control device as set forth in claim 1, comprising a high pass for the derivation of the target electrical drive force values and/or a low pass for the derivation of the target fluid drive force values and/or a frequency responsive switch.

7. The position control device as set forth in claim 1, comprising for the derivation of the target fluid drive force values and of the target electrical drive force values it is so designed that the fluid power actuator in a time averaged manner produces a larger drive force fraction for the positioning of the force output point than the electrical actuator.

8. The position control device as set forth in claim 1, wherein the target fluid drive force values constitute input values for pressure regulating means or pressure control means for fluid power control of the fluid power actuator and/or the target electrical drive force values constitute input values for current regulating means or current control means for electrical control of the electrical actuator.

9. The position control device as set forth in claim 8, wherein the current regulating means or the current control means are designed for error compensation as regards control deviations caused by the pressure regulating means or by the pressure control means.

10. The position control device as set forth in claim 1, having an adjustable and more especially frequency-dependent force splitting factor for splitting the target overall drive force values between the target fluid drive force values and the target electrical drive force values.

11. The position control device as set forth in claim 1, wherein the fluid power actuator and the electrical actuator are provided for simultaneous motion of the force output point to the position location.

12. The position control device as set forth in claim 1, comprising position regulating means, more especially for deriving the target overall drive force values.

13. The position control device as set forth in claim 1, wherein for precision positioning of the force output point it essentially operates the electrical actuator.

14. The position control device as set forth in claim 1, wherein to cover the case of an electrical actuator being inactive or not being present, it is designed for operation of the fluid power actuator only and vice versa.

15. The position control device as set forth in claim 1, having processor executable program code.

16. A position control device for an electrical-fluid power drive comprising a force output point, and a fluid power actuator together with an electrical actuator for driving the force output point wherein said device is designed to derive the target overall drive force values of a target overall drive force, to be provided by the fluid power actuator and the electrical actuator jointly, for a positioning movement of the force output point to a positioning location able to be predetermined for the position control device, to derive target fluid drive force values of a target fluid power drive force, to be provided by the fluid power actuator, and to derive target electrical drive force values of a target electrical drive force to be provided by the electrical actuator, the target fluid drive force values, and the target electrical drive force values being derived on the basis of the target overall drive force values in such a manner that the target electrical drive force is provided during those portions of the target overall drive force comprising a higher rate of change or frequency of change than those portions of the target overall drive force during which the target fluid power drive force is provided, wherein the position control device is designed for the derivation of the target fluid drive force values and of the target electrical drive force values in a fashion dependent on the change rate or change frequency of the target overall drive force values.

17. An electrical-fluid power drive comprising a fluid power actuator together with an electrical actuator for driving an force output point and further comprising a position control device for the electrical-fluid power drive and the fluid power actuator wherein said device is designed to derive the target overall drive force values of a target overall drive force, to be provided by the fluid power actuator and the electrical actuator jointly, for a positioning movement of the force output point to a positioning location able to be predetermined for the position control device, to derive target fluid drive force values of a target fluid power drive force, to be provided by the fluid power actuator, and to derive target electrical drive force values of a target electrical drive force to be provided by the electrical actuator, the target fluid drive force values and the target electrical drive force values being derived on the basis of the target overall drive force values in such a manner that the target electrical drive force is provided during those portions of the target overall drive force comprising a higher rate of change or frequency of change than those portions of the target overall drive force during which the target fluid power drive force is provided, wherein the position control device is designed for the derivation of the target fluid drive force values and of the target electrical drive force values in a fashion dependent on the change rate or change frequency of the target overall drive force values.

18. The electrical-fluid power drive as set forth in claim 17, wherein the position control device is designed for the derivation of the target fluid drive force values and of the target electrical drive force values in a fashion dependent on the change rate or change frequency of the target overall drive force values.

19. The electrical-fluid power drive as set forth in claim 17, comprising pressure sensors and/or position detecting means and/or fluid power switching valve and/or proportional valves.

20. The electrical-fluid power drive as set forth in claim 17, wherein the electrical actuator and the fluid power actuator constitute an integrated drive unit.

21. The electrical-fluid power drive as set forth in claim 17, wherein the electrical actuator and the fluid power actuator are coupled linear drives and/or rotary drives.

22. The electrical-fluid power drive as set forth in claim 17, having a modular design.

23. A method for position control for an electrical-fluid power drive comprising a force output point, and a fluid power actuator together with an electrical actuator for driving the force output point, comprising the steps of:

deriving an overall target overall drive force to be produced by the fluid power actuator and the electrical actuator for a positioning movement of the force output point toward a position location predetermined for the position control device;

deriving a target fluid drive force to be produced by the fluid power actuator and a target electrical drive force to be produced by the electrical actuator on the basis of the target overall drive force in such a manner that the target electrical drive force is provided during those portions of the target overall drive force comprising a higher rate of change or frequency of change than those portions of the target overall drive force during which the target fluid drive force is provided; and operating the fluid power actuator in accordance with the target fluid drive force and the electrical actuator in accordance with the target electrical drive force, wherein the position control device is designed for the derivation of the target fluid drive force values and of the target electrical drive force values in a fashion dependent on the change rate or change frequency of the target overall drive force values.

24. A method for position control for an electrical-fluid power drive comprising a force output point, and a fluid power actuator together with an electrical actuator for driving the force output point, comprising the steps of:

deriving an overall target overall drive force to be produced by the fluid power actuator and the electrical actuator for a positioning movement of the force output point toward a position location predetermined for the position control device;

deriving a target fluid drive force to be produced by the fluid power actuator and a target electrical drive force to be produced by the electrical actuator on the basis of the target overall drive force in such a manner that the target electrical drive force is provided during those portions of the target overall drive force comprising a higher rate of change or frequency of change than those portions of the target overall drive force during which the target fluid drive force is provided, wherein the target fluid drive force values and the target electrical drive force values are dependent on the change rate or change frequency of the target overall drive force values; and operating the fluid power actuator in accordance with the target fluid drive force and the electrical actuator in accordance with the target electrical drive force.

* * * * *